US006390109B1

(12) United States Patent
Manninen

(10) Patent No.: US 6,390,109 B1
(45) Date of Patent: May 21, 2002

(54) POLE PROVIDED WITH A QUICK-RELEASING INTERCHANGEABLE LATERAL SUPPORT EXTENSION

(75) Inventor: Taisto Manninen, Mäntyharju (FI)

(73) Assignee: Exel Oyj, Mantyharju (FI)

( * ) Notice: Subject to any disclaimer, the term of this patent is extended or adjusted under 35 U.S.C. 154(b) by 0 days.

(21) Appl. No.: 09/500,045

(22) Filed: Feb. 8, 2000

(30) Foreign Application Priority Data

Feb. 8, 1999 (FI) ..... 990235

(51) Int. Cl.[7] ..... A63C 11/24

(52) U.S. Cl. ..... 135/77; 135/65; 135/78; 280/819; 280/824

(58) Field of Search ..... 135/78, 77, 65; 280/824, 819; 403/292, 319

(56) References Cited

U.S. PATENT DOCUMENTS

| | | | | |
|---|---|---|---|---|
| 3,963,254 A | | 6/1976 | Aho | |
| 4,385,776 A | | 5/1983 | Pronzati | |
| 4,669,752 A | | 6/1987 | Jackson et al. | |
| 4,787,652 A | * | 11/1988 | Pronzati | 280/824 |
| 4,955,696 A | * | 9/1990 | Jansson et al. | 280/824 |

FOREIGN PATENT DOCUMENTS

| | | |
|---|---|---|
| DE | 2905147 | 8/1980 |
| NO | 134406 | 6/1976 |
| NO | 144471 | 1/1981 |

OTHER PUBLICATIONS

Derwent Abstract WPI Acc NO: 80–H4231C/*198035* for DE 29 05 147 D1.

* cited by examiner

*Primary Examiner*—Robert Canfield
(74) *Attorney, Agent, or Firm*—Rothwell, Figg, Ernst & Manbeck p.c.

(57) ABSTRACT

The object of the invention is a pole provided with a quick-releasing interchangeable lateral support extension, especially a walking, skiing, alpine skiing or other sports pole. Around the lower end of the pole (1) is injection molded a sleeve socket (2) from which a guide projection (3) and a locking projection (4) protrude. The lateral support extension sleeve (6, 8) includes a resilient tongue (12), below which there is a receiving aperture (14) for the locking projection (4). The sleeve also includes a guide groove (11) for receiving the guide projection (3). The lateral support extension (5) is easy to detach by turning the resilient tongue (12) outwards.

5 Claims, 2 Drawing Sheets

POLE PROVIDED WITH A QUICK-RELEASING INTERCHANGEABLE LATERAL SUPPORT EXTENSION

BACKGROUND OF THE INVENTION

1. Field of the Invention

The object of the invention is a pole provided with a quick-releasing interchangeable lateral support extension, especially a walking, skiing, alpine skiing, or other sports pole, which comprises a pole rod proper, a lateral support extension fastened to the lower end of the pole rod, the said lateral support extension comprising a sleeve-like part and a bearing surface extension, and quick-release means for fastening the pole releasably inside the sleeve-like part of the lateral support extension, the quick-release means comprising

- a sleeve socket, which is fixed onto the pole tube by die casting or injection moulding, and which sleeve socket has an upper end through which the pole tube emerges, and a lower end;
- a resilient locking tongue in the sleeve-like part of the lateral support extension;
- a locking projection protruding from the sleeve socket, behind which projection the locking tongue attaches by means of a snap joint.

It is known in connection with ski poles to fasten the interchangeable lateral support extension to the pole using an adhesive, which softens when heated, in which case, e.g. a broken lateral support extension can be replaced by a new one. In connection with alpine skiing poles, it is known to fasten the lateral support extension to the lower end of the pole by means of a threaded joint.

2. Description of the Background Art

In connection with ski poles and alpine skiing poles the term "lateral support extension" means the same as "snow ring", but in connection with walking poles, for instance, it may be a kind of "asphalt paw".

A pole provided with a quick-releasing interchangeable lateral support extension of the type mentioned at the beginning is known from the patent publication U.S. Pat. No. 4,385,776. In this known pole, the quick-releasing means are provided only for the purpose of replacing the bearing surface of the lateral support extension, while the spike is fixed to the sleeve socket integral with the pole. This quick-release locking arrangement is not suitable for the quick-release locking of lateral support extensions with varying uses. As the uses vary, it must also be possible to vary the mutual positioning of the spike and the bearing surface.

SUMMARY OF THE INVENTION

The aim of the invention is to achieve quick-release locking between the lateral support extension and the pole, by means of which locking it will be possible to change a wider range of different lateral support extensions to the pole than before. This means that the same poles can be used in varying weather conditions and for several different purposes simply by changing to a lateral support extension suitable for the conditions and use at a given time.

This aim is achieved by means of the invention, on the basis of the characteristics disclosed.

BRIEF DESCRIPTION OF THE DRAWINGS

One embodiment of the invention is described in greater detail in the following, with reference to the appended drawings in which.

DETAILED DESCRIPTION OF THE INVENTION

Figure 1A:
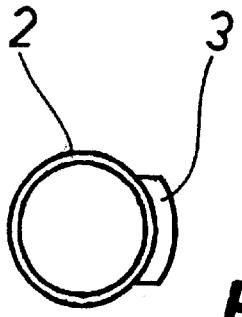
FIG. 1A shows the same sleeve socket in the axial direction, as seen from above.
Figure 1:
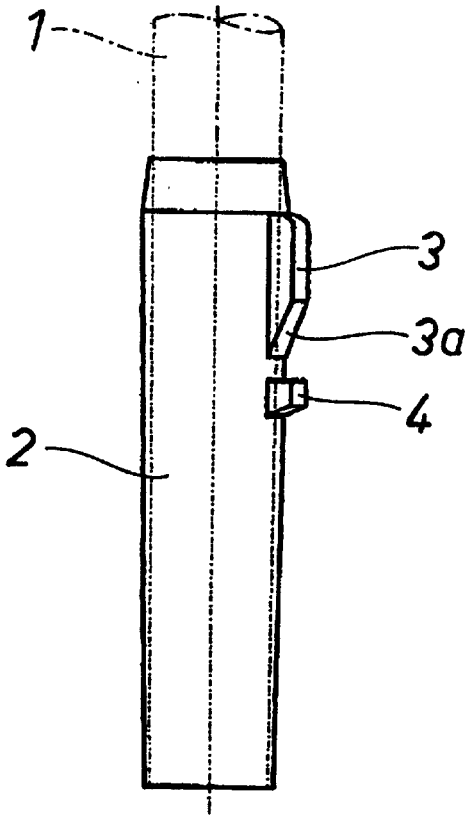
FIG. 1 shows the sleeve socket fastened to the lower end of the pole relating to the invention.
Figure 2:
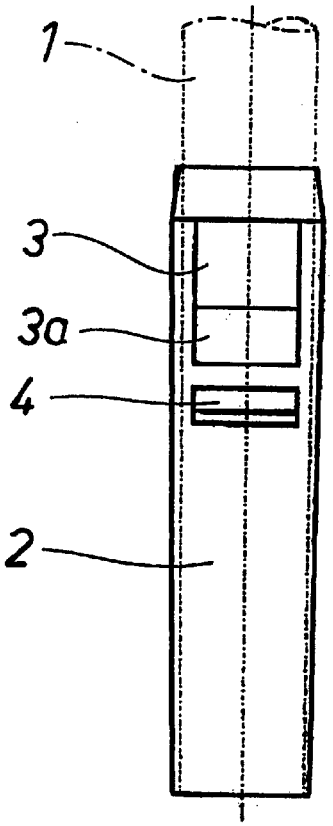
FIG. 2 shows the sleeve socket shown in FIG. 1 when turned by 90° with respect to FIG. 1.
Figure 3:
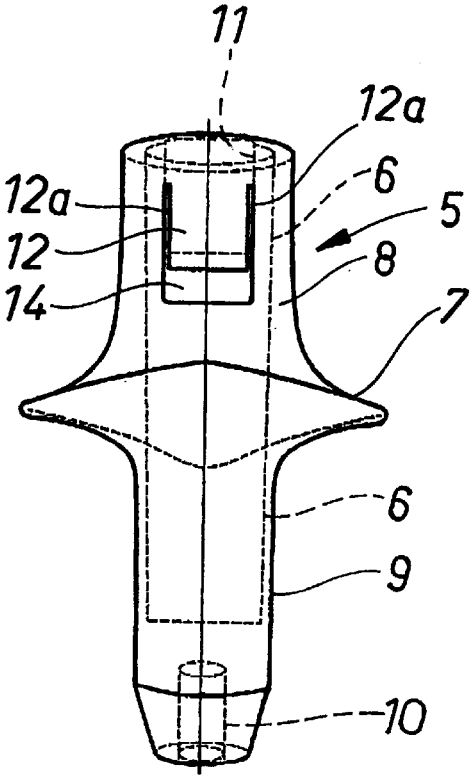
FIG. 3 shows one type of interchangeable lateral support extension used in the pole relating to the invention, as seen from behind.
Figure 4:
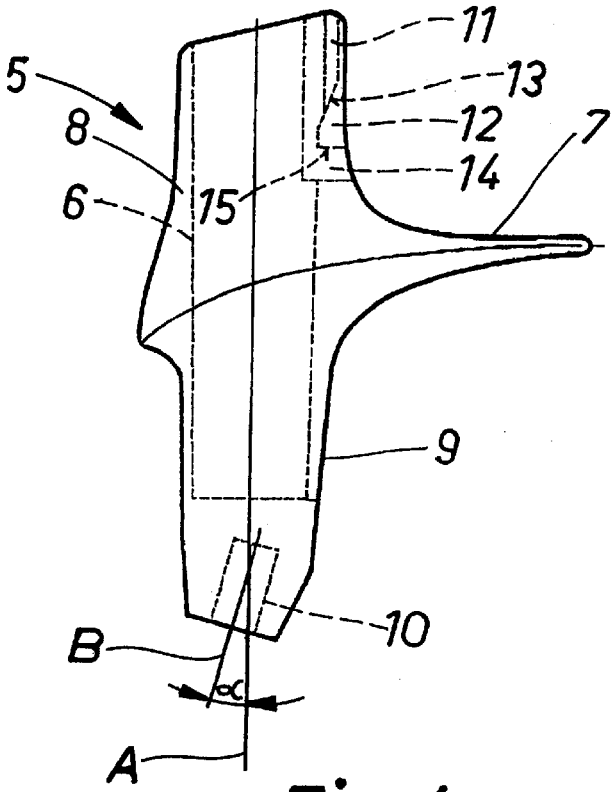
FIG. 4 shows the lateral support extension shown in FIG. 3 as seen from the side.
Figure 5:
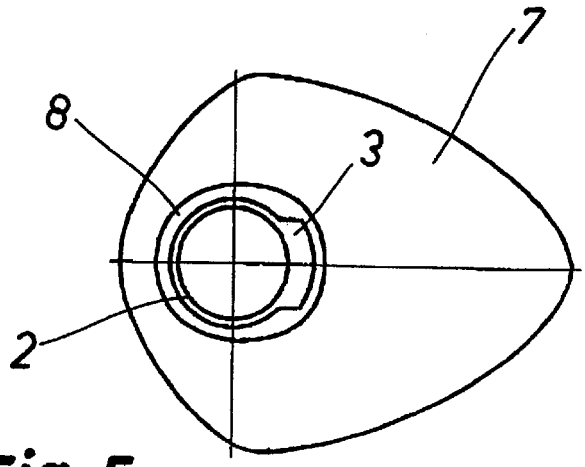
FIG. 5 shows the same lateral support extension, as seen from above, when the sleeve socket relating to FIGS. 1 and 2 is inside the lateral support extension.

The sleeve socket shown in FIGS. 1 and 2 is fixed around the lower end of the pole 1 by means of injection molding. The pole 1 may be, for example, a tube of composite construction, and the sleeve socket 2 is made of plastic suitable for injection molding, for example, the same plastic from which the lateral support extension is also made. The pole tube 1 thus emerges through the upper end of the sleeve socket and the outside diameter of the sleeve socket 2 is dimensioned so as to fit inside the sleeve-like part 6, 8, 9 of the lateral support extension part 5 with suitable slide fit, with a view to ease of replacement of the lateral support extension.

From the sleeve socket 2 protrudes a guide projection 3 close to the upper end of the sleeve. Below the guide projection 3 is a locking projection 4.

At the upper end of the sleeve-like part 6, 8, 9 of the lateral support extension is a guide groove 11 which is dimensioned to receive the guide projection 3. As an extension to the guide groove 11, there is a resilient locking tongue 12, on the sides of which are slots 12*a* which allow for the resilient bending of the tongue 12 outwards when the locking projection 4 is pushed past the tongue 12 to the locking aperture 14. The locking aperture 14 is thus bordered by the end face 15 of the locking tongue 12, behind which the locking projection 4 attaches, when the resilient tongue 12 snaps into place. The guide projection 3 remains in the guide groove 11. The bevel surface 13 of the locking tongue 12 allows the passing of the locking projection 4. The guide projection 3 has a corresponding bevel surface 3*a* against which the bevel surface 13 of the tongue 12 comes when the lateral support extension is locked into place. The inwards directed tappet of the locking tongue 12 remains between the projections 3 and 4.

The lateral support extension 5 is easy to detach by turning the locking tongue 12 outwards, for example, with the tip of a screwdriver, whereby the locking projection 4 is released from behind the end face 15 of the tongue 12.

In the case disclosed, projections 3 and 4 are equally wide, but projection 4 could be narrower and correspondingly aperture 14 could also be narrower leaving, however, a suitable slot next to projection 4, through which gap the tip of a screwdriver can be pushed under the edge of the tongue 12 to bend the tongue 12 outwards in order to release the locking.

The distance of the locking projection 4 from the lower end of the sleeve 2 is naturally equal to the distance of the locking aperture 14 from the bottom of the receiving cylinder 6 of the lateral support extension, which means that the lower end of the sleeve 2 receives those forces exerted on the lateral support extension 5, which are directed upwards. Forces exerted on the lateral support extension in the opposite direction are minor and such forces can be received by the projection 4 and the tongue 12.

In the case disclosed, the lateral support extension part 5 has an asymmetrical bearing surface 7, and the locking tongue 12 and locking aperture 14 are situated above the bearing surface extension 7. The hand grip (not shown) incorporated in the pole 1 is placed in such a position that the maximum reach of the asymmetrical bearing surface 7 points backwards in the situation when the pole is being used.

At the lower end of the sleeve-like part 6, 8, 9 of the lateral support extension is a spike (not shown) receiving recess 10, the axial direction B of which deviates from the axial direction A of the lateral support extension sleeve at such an angle $\alpha$ that the part of the spike which comes out is directed diagonally forward, to the opposite side of the centre axis line. A of the lateral support extension sleeve with respect to the locking tongue 12 and/or the maximum reach of the asymmetrical bearing surface extension 7.

The lateral support extension 5 type shown is only one possible example of the various types of lateral support extensions which can be changed to the pole by utilising the quick-release locking relating to the invention.

What is claimed is:

1. A pole provided with a quick-releasing interchangeable lateral support extension, which comprises a pole rod (1), a lateral support extension (5) fastened to the lower end of the pole rod, the said lateral support extension comprising a sleeve-like part (6, 8, 9) and a bearing surface extension (7), and quick-release means for fastening the pole rod (1) releasably inside the sleeve-like part of the lateral support extension (5), the quick-release means comprising a sleeve socket (2), which is fixed onto the pole rod (1) by die casting or injection moulding, and which sleeve socket (2) has an upper end through which the pole tube (1) emerges, and a lower end;

a resilient locking tongue (12) in the sleeve-like part (6, 8) of the lateral support extension;

a locking projection (4) protruding from the sleeve socket, behind which projection the locking tongue (12) attaches by means of a snap joint characterised in that the lower end of the sleeve socket is fitted to remain inside the sleeve-like part (6, 8, 9) of the lateral support extension part (5);

the sleeve socket (2) comprises a guide projection (3) protruding to the side near the upper end of the sleeve socket so that the said locking projection (4) remains below the guide projection (3);

there is a guide groove (11) at the upper end of the sleeve-like part (6, 8, 9) of the lateral support extension, the said groove being dimensioned to receive the guide projection (3); and that there is a locking aperture (14) bordered by the locking tongue (12) in the sleeve-like part of the lateral support extension, the said aperture receiving the locking projection (4);

which means that the locking projection (4) can be pushed into the locking aperture (14) past the resilient locking tongue (12), while the tongue (12) bends and snaps into the locking position behind the locking projection (4) at the same time as the guide projection (3) remains in the guide groove (11).

2. A pole provided with a quick-releasing interchangeable lateral support extension, which comprises a pole rod (1), a lateral support extension (5) fastened to the lower end of the pole rod, the said lateral support extension comprising a sleeve-like part (6, 8, 9) and a bearing surface extension (7), and quick-release means for fastening the pole rod (1) releasably inside the sleeve-like part of the lateral support extension (5), the quick-release means comprising a sleeve socket (2), which is fixed onto the pole rod (1) by die casting or injection moulding, and which sleeve socket (2) has an upper end through which the pole tube (1) emerges, and a lower end;

a resilient locking tongue (12) in the sleeve-like part (6, 8) of the lateral support extension;

a locking projection (4) protruding from the sleeve socket, behind which projection the locking tongue (12) attaches by means of a snap joint characterised in that the lower end of the sleeve socket is fitted to remain inside the sleeve-like part (6, 8, 9) of the lateral support extension part (5); and the locking tongue (12) and the locking aperture (14) which receives it in the sleeve-like part (6, 8, 9) of the lateral support extension are above the bearing surface extension (7) of the lateral support extension part (5).

3. A pole as claimed in claim 1, characterised in that the locking tongue (12) has an inwards directed tappet, which has a bevel top side (13) and which remains between the guide projection (3) and the locking projection (4).

4. A pole as claimed in claim 1, characterised in that the locking tongue (12) and the locking aperture (14) are above the bearing surface extension (7) of the lateral support extension part (5).

5. A pole as claimed in claim 1, characterised in that at the lower end of the sleeve-like part (6, 8, 9) of the lateral support extension part (5) is a spike receiving recess (10), the axial direction (B) of which deviates from the axial direction (A) of the sleeve part (6, 8, 9) at such an angle ($\alpha$) that the part of the spike which comes cut is directed to the opposite side of the centre axis line (A) of the lateral support extension sleeve (6, 8, 9) with respect to the locking tongue (12) and/or the maximum reach of the asymmetrical bearing surface extension (7).

* * * * *